US009193084B2

(12) United States Patent
Chen et al.

(10) Patent No.: US 9,193,084 B2
(45) Date of Patent: Nov. 24, 2015

(54) CUTTING MECHANISM AND CUTTING DEVICE USING THE SAME

(75) Inventors: Wen-Sheng Chen, Shenzhen (CN); Hai-Bo Zhou, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 581 days.

(21) Appl. No.: 13/458,385

(22) Filed: Apr. 27, 2012

(65) Prior Publication Data

US 2013/0081279 A1 Apr. 4, 2013

(30) Foreign Application Priority Data

Sep. 30, 2011 (CN) ..... 2011 1 0291766

(51) Int. Cl.

| | |
|---|---|
| ***B26D 7/00*** | (2006.01) |
| ***B26D 7/06*** | (2006.01) |
| ***B26D 1/08*** | (2006.01) |
| ***B26D 7/28*** | (2006.01) |

(52) U.S. Cl.

CPC .. *B26D 7/06* (2013.01); *B26D 1/08* (2013.01); *B26D 7/28* (2013.01)

(58) Field of Classification Search

CPC ..... B26D 7/06; B26D 7/28; B26D 1/08

USPC ..... 83/649, 650, 648, 613

See application file for complete search history.

(56) References Cited

U.S. PATENT DOCUMENTS

| | | | | | |
|---|---|---|---|---|---|
| 3,398,502 | A | * | 8/1968 | Halstead | 53/138.8 |
| 3,439,606 | A | * | 4/1969 | Bursik et al. | 100/26 |
| 4,488,466 | A | * | 12/1984 | Jones | 83/175 |
| 4,589,319 | A | * | 5/1986 | Litehizer, Jr. | 83/423 |
| 5,045,144 | A | | 9/1991 | Bonemi | |
| 5,056,729 | A | * | 10/1991 | Spehar | 242/524.1 |
| 5,465,659 | A | * | 11/1995 | Minen | 100/30 |
| 5,872,715 | A | * | 2/1999 | Bechtle | 700/167 |
| 8,371,197 | B2 | * | 2/2013 | Lee et al. | 83/164 |

FOREIGN PATENT DOCUMENTS

| | | |
|---|---|---|
| CN | 201102257 Y | 8/2008 |
| TW | 289280 | 10/1996 |
| TW | 487024 | 5/2002 |

* cited by examiner

*Primary Examiner* — Omar Flores Sanchez

(74) *Attorney, Agent, or Firm* — Novak Druce Connolly Bove + Quigg LLP

(57) ABSTRACT

A cutting mechanism for cutting a pipe includes a fixing board, a cutter mounted on the fixing board and a driving assembly. The cutter includes a base body, and a blade positioned on the base body. The driving assembly is mounted on the fixing board for driving the pipe move to the blade to be cut into pieces of certain lengths.

16 Claims, 5 Drawing Sheets

CUTTING MECHANISM AND CUTTING DEVICE USING THE SAME

TECHNICAL FIELD

The present disclosure relates to cutting mechanisms, and particularly, to cutting mechanisms used in cutting devices.

DESCRIPTION OF RELATED ART

In the assembly of electronic devices, wires or pipes, such as heat shrink tube, may be used in connecting and assembling electronic elements. The wires or pipes provided by factories may need cutting. Manual cutting is not accurate, and consumes too much time and labor.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
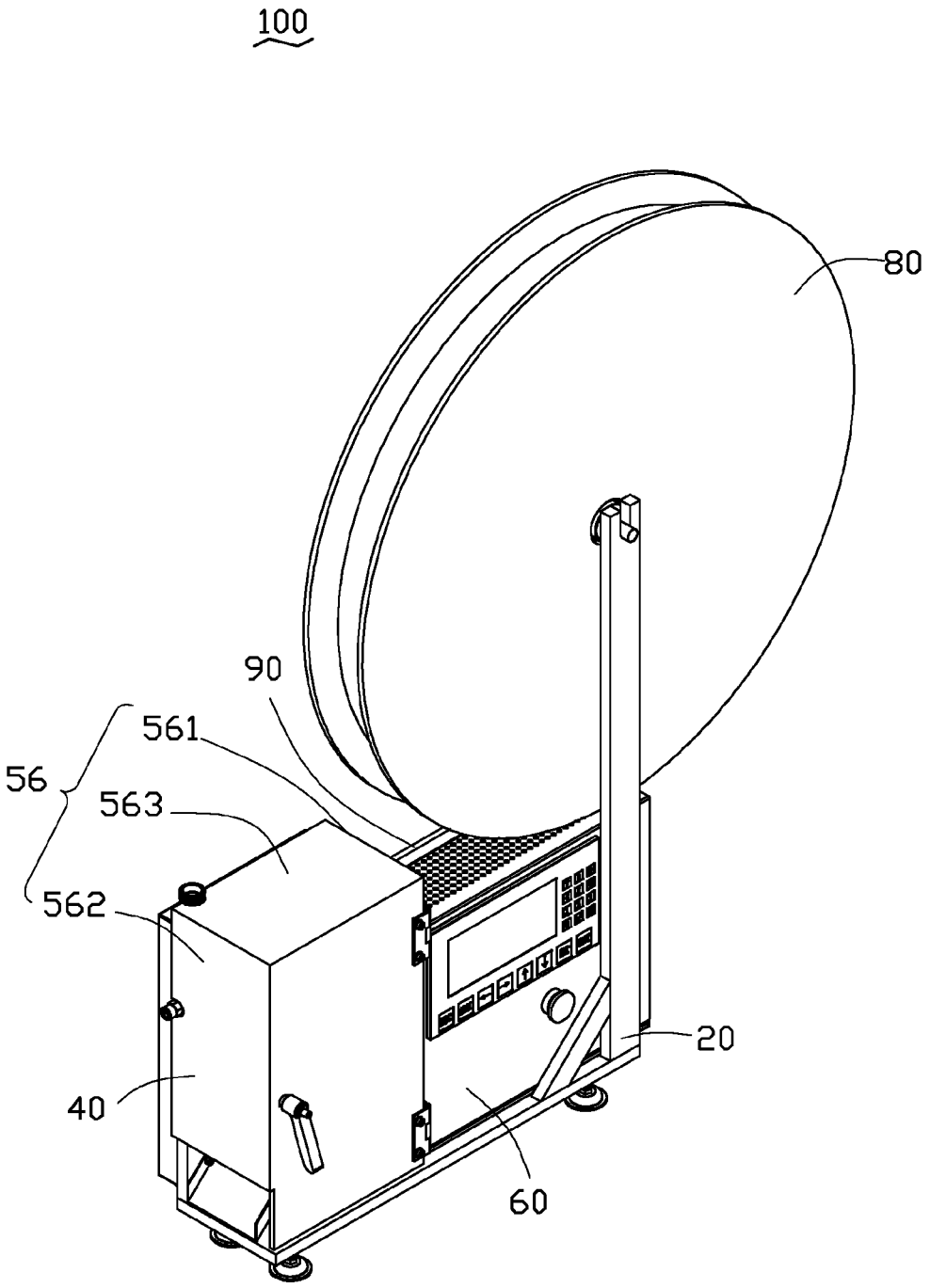
FIG. 1 is an isometric view of an embodiment of a cutting device.

FIG. 1 shows a cutting device 100 for cutting a pipe 90 into pieces (not shown) of certain lengths. The pipe 90 is made of plastic, rubber and other non-metallic materials. In the illustrated embodiment, the pipe 90 is a heat shrink tube. The cutting device 100 includes a support body 20, a cutting mechanism 40, a counter 60 and a rolling drum 80. The cutting mechanism 40 and the counter 60 are positioned on the support body 20. The rolling drum 80 is rotatably mounted on the support body 20 above the cutting mechanism 40 and the counter 60 for presenting the pipe 90. The cutting mechanism 40 cuts the pipe 90 into pieces at certain lengths; the counter 60 counts the number of the pieces which are cut.

Figure 2:
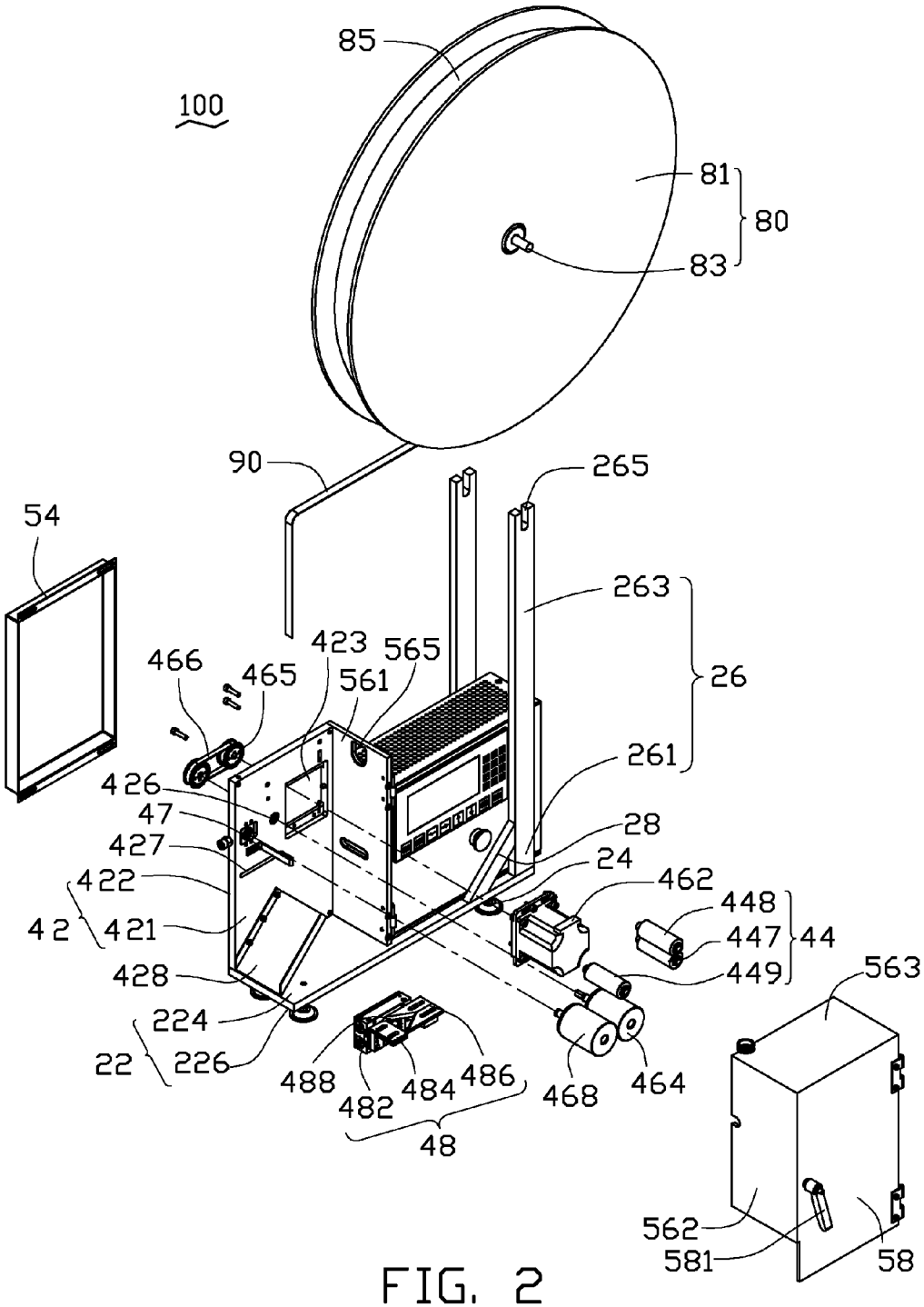
FIG. 2 is an exploded, isometric view of the cutting device of the FIG. 1.
Figure 3:
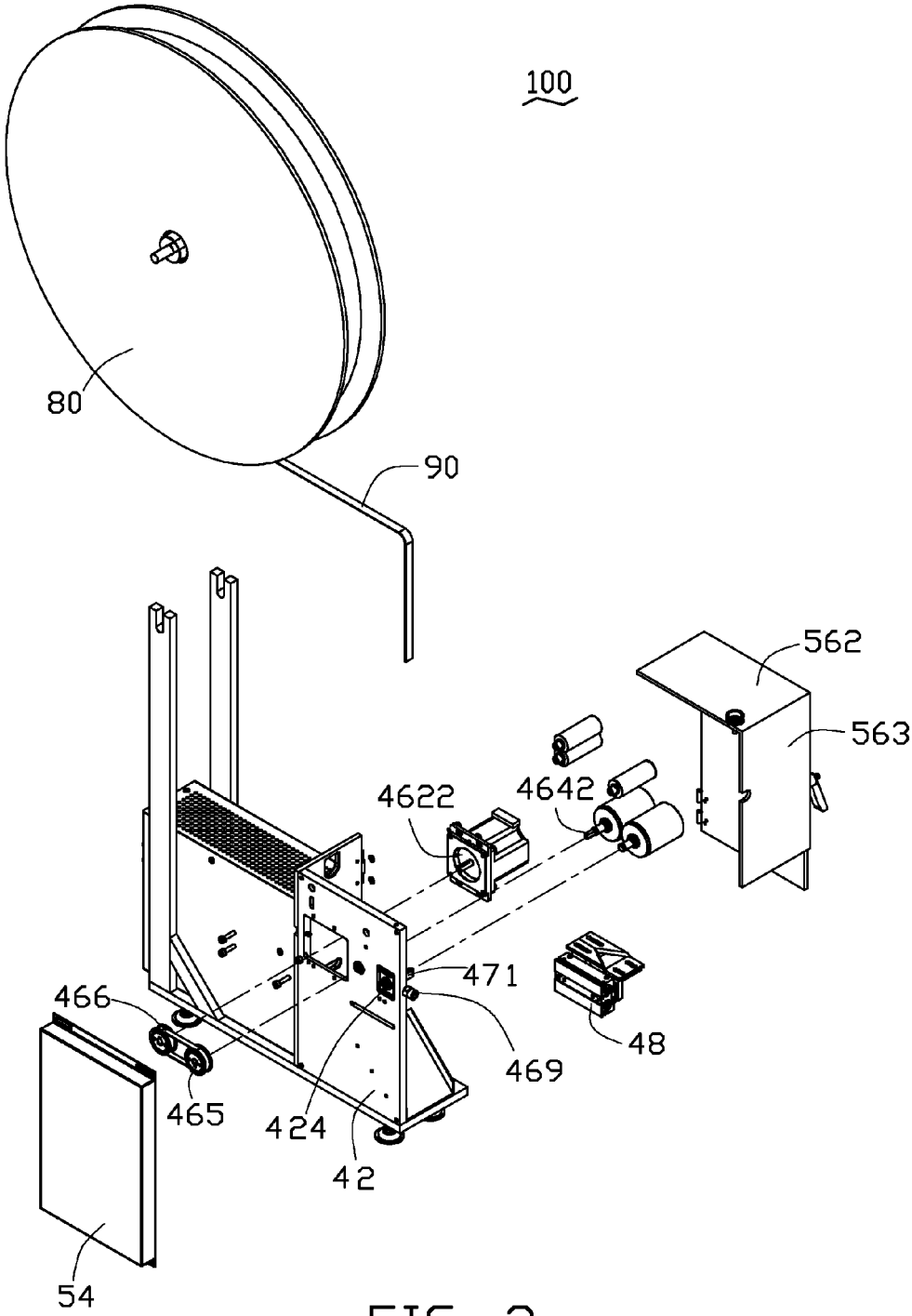
FIG. 3 is similar to FIG. 2, but viewed from another aspect.

Referring to FIGS. 2 and 3, the support body 20 includes a support table 22, four table feet 24, a pair of support rods 26 and a pair of strength rods 28. The support table 22 is substantially rectangular, and includes a support surface 224 and a mounting surface 226 opposite to the support surface 224. Four table feet 24 are installed at four corners of the mounting surface 226, respectively. The two support rods 26 are positioned on two ends of one edge of the support surface 224. Each support rod 26 includes an installing end 261 and a pivot end 263 opposite to the installing end 261. Each installing end 261 is perpendicularly fixed to the support surface 224. Two strength rods 28 are positioned adjacent two joints of the support rods 26 and the support surface 224, respectively. Each strength rod 28 connects a corresponding support rod 26 and a corresponding edge of the support surface 224. The two strength rods 28 are parallel to each other. In this embodiment, an end of each strength rod 28 away from the support surface 224 is fixed to the installing end 261 for reinforcing the structural integrity of the support body 20.

Figure 4:
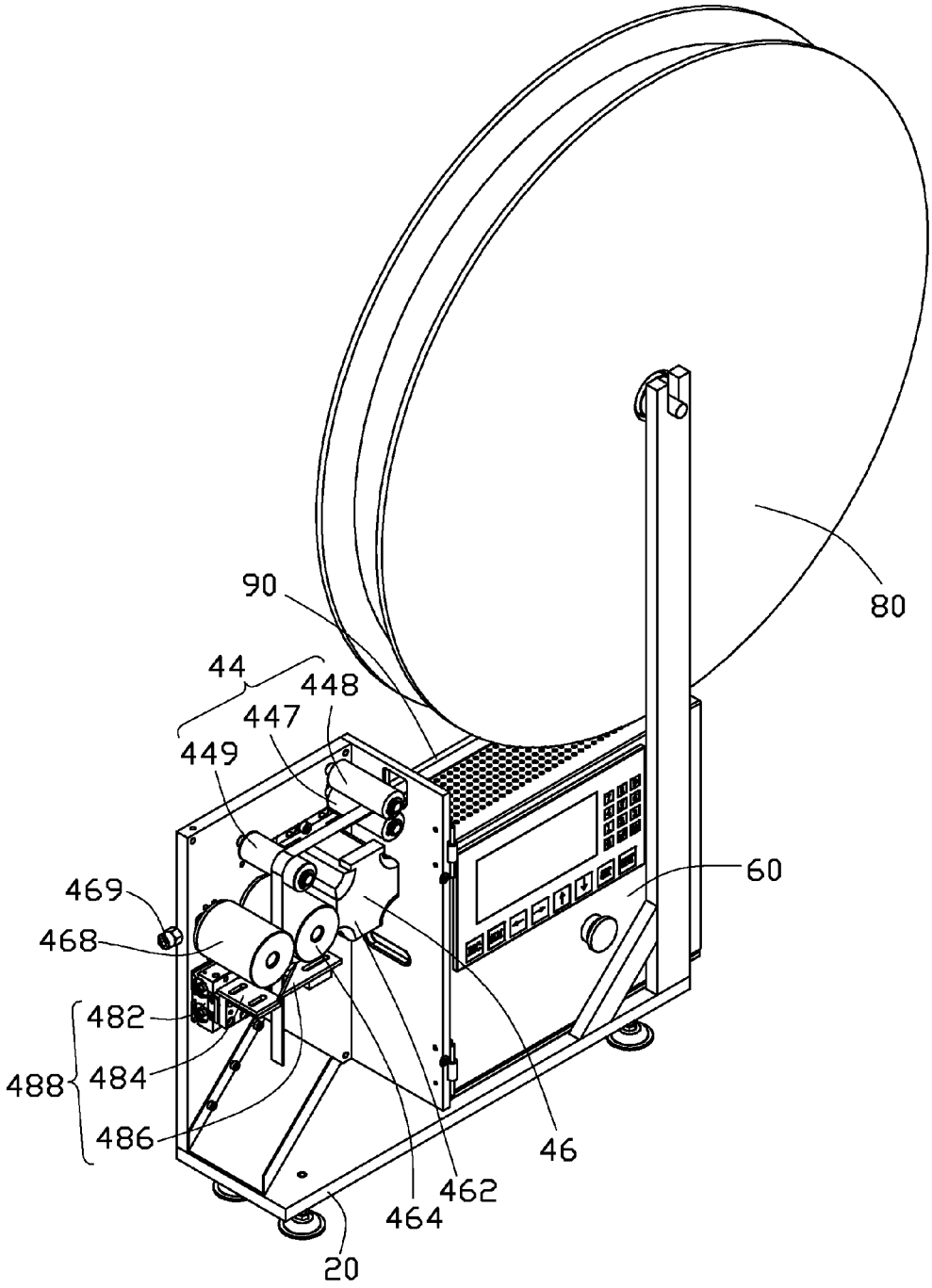
FIG. 4 is an isometric view of the cutting device without a cover and a panel.
Figure 5:
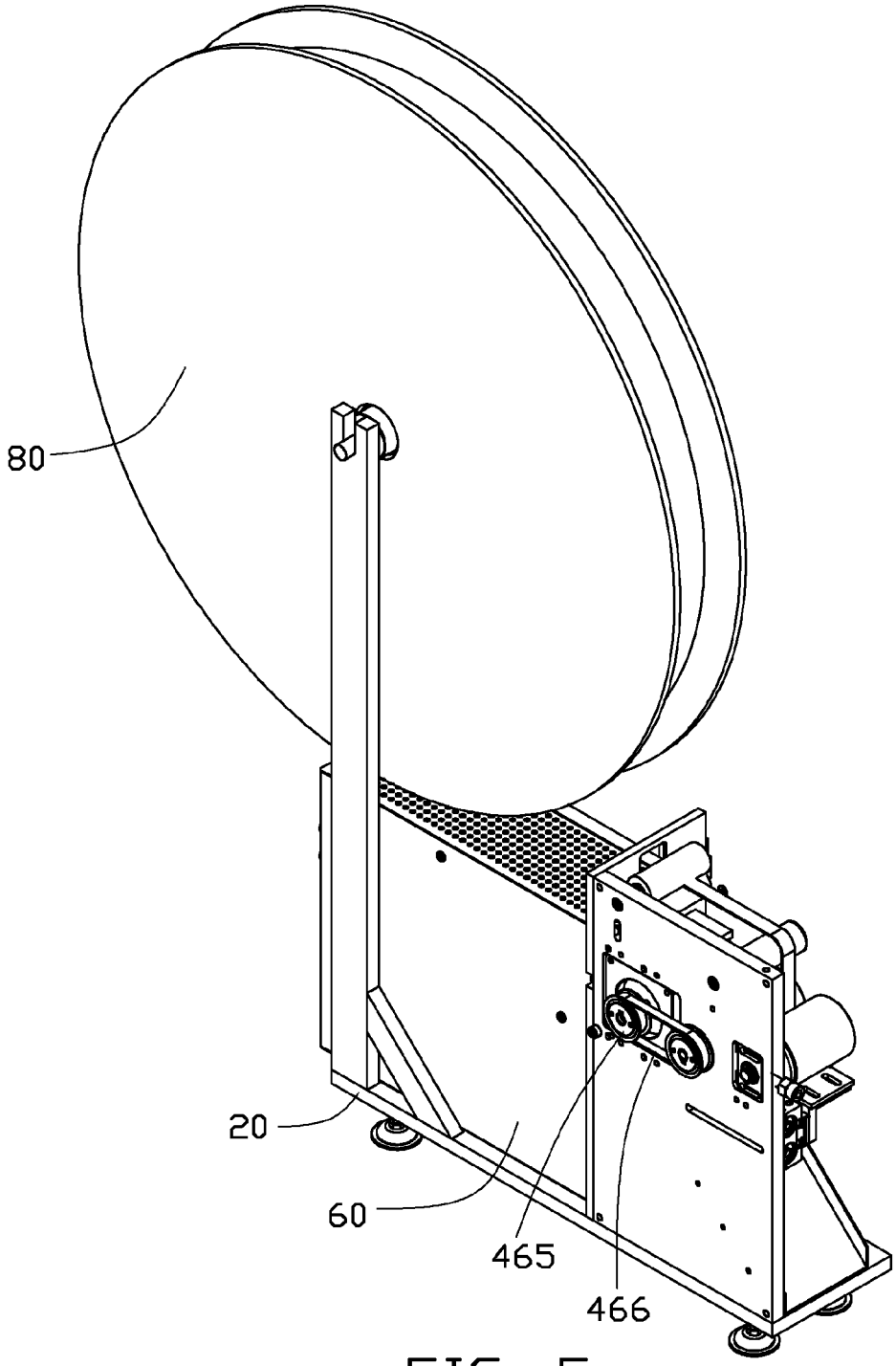
FIG. 5 is similar to FIG. 4, but viewed from another aspect.

Also referring to FIGS. 4 and 5, the cutting mechanism 40 is mounted on an end of the support surface 224 away from the support rods 26. The cutting mechanism 40 includes a fixing board 42, a roller group 44, a driving assembly 46, a guiding member 47 and a cutter 48. The fixing board 42 is perpendicularly positioned on one edge of the support surface 224 adjacent to the support rod 26. The roller group 44 is rotatably mounted on an end of the fixing board 42 away from the support table 22 for guiding the pipe 90 to the driving assembly 46. The driving assembly 46 is fixed to the fixing board 42 under the roller group 44. The driving assembly 46 pulls or drives the pipe 90 to the cutter 48 for cutting. The guiding member 47 is installed on the fixing board 42, between the driving assembly 46 and the cutter 48 to guide the pipe 90 to the cutter 48.

The fixing board 42 includes a first fixing surface 421 and a second fixing surface 422 opposite to the first fixing surface 421. A rectangular mounting hole 423 is defined in the end of the fixing board 42 away from the support table 22. An installing portion 424 (see FIG. 3) is recessed in the fixing board 42 adjacent to the mounting hole 423. A rotating hole 426 is defined in the fixing board 42, between the mounting hole 423 and the installing portion 424. A strip clamping groove 427 is formed in the fixing board 42 under the installing portion 424. A slanted sliding trough 428 is further installed on the fixing surface 421 under the clamping groove 427 to guide the pieces out of the cutting mechanism 40.

The roller group 44 is rotatably installed on one end of the first fixing surface 421 above the mounting hole 423. The roller group 44 includes a first roller 447, a second roller 448 and a third roller 449. The first roller 447 is rotatably connected with the first fixing surface 421. The first roller 447 is above the mounting hole 423 and adjacent to an edge of the first fixing surface 421. The second roller 448 is rotatably positioned on the first fixing surface 421 and above the first roller 447. The third roller 449 is also rotatably mounted on the first fixing surface 421, and is coplanar with and parallel to the first roller 447.

The driving assembly 46 is mounted on the first fixing surface 421 under the roller group 44. The driving assembly 46 includes a driver 462, a driving wheel 464, a pair of pulley wheels 465, a strap 466, a driven wheel 468 and an adjustment member 469. The driver 462 is mounted on the first fixing surface 421 for driving the driving wheel 464. The driver 462 includes a rotating shaft 4622 passing through the mounting hole 423. In the illustrated embodiment, the driver 462 is a motor. The driving wheel 464 is mounted on the first fixing surface 421 for driving the driven wheel 468. The driving wheel 464 includes a rotating shaft 4642 passing through the rotating hole 426. The pulley wheels 465 are rotatably sleeved on the rotating shafts 4622 and 4642 on the second fixing surface 422. The strap 466 runs over the pair of pulley wheels 465. The driven wheel 468 is installed in the installing portion 424 adjacent to the driving wheel 464. The adjustment member 469 passes through one edge adjoining the driven wheel 468 and resists the driven wheel 468.

The guiding member 47 is connected with the first fixing surface 421 under the driven wheel 468. An inserting portion 471 is formed in an end away from the first fixing surface 421 of the guiding member 47 to guide the pipe 90 to the cutter 48.

The cutter 48 is mounted on the first fixing surface 421 via the clamping groove 427. The cutter 48 includes a base body 482, a pushing block 484 and a blade 486. In the illustrated embodiment, the base body 482 is a cylinder, mounted on the first fixing surface 421 via the clamping groove 427. The pushing block 484 and the blade 486 are perpendicularly movable and positioned on opposite ends of the base body 482. The pushing block 484 is a planar board under the driven wheel 468 for pushing the pipe 90 to the blade 486. The blade 486 is substantially M-shaped. The blade edge 488 of the blade 486 faces the pushing block 484. In alternative embodiments, one of the pushing block 484 and the blade 486 may be fixed and the other may be movably positioned on the base body 482.

Referring to FIG. 3, the cutting mechanism 40 further includes a cover 54, a side board assembly 56, and a panel 58. The cover 54 covers the second fixing surface 422. A receiving room (not shown) is formed by the cover 54 and the fixing board 42 to receive the pulley wheels 465 and the strap 466. The side board assembly 56 is perpendicularly connected to the edges of the fixing board 42. The side board assembly 56 includes a first side board 561, a second side board 562 opposite to the first side board 561, and a third side board 563 opposite to the support table 22.

The first side board 561 is perpendicularly mounted on the edge of the fixing board 42 adjacent to the mounting hole 423 and also perpendicularly connected to the support surface 224. A through hole 565 is defined at one end of the first side board 561 away from the support surface 224. The second side board 562 is mounted on one end of the edge of the fixing board 563 away from the support table 22. The length of the second side board 562 is shorter than the fixing board 42 to guide the pieces sliding from the sliding trough 428 out of the cutting mechanism 40. The third side board 563 is perpendicularly connected the first side board 561, the second side board 562 and the fixing board 42 away from the support table 22. The panel 58 may pivot on an edge of the first side board 561 away from the fixing board 42. A handle 581 is mounted on an edge of the panel 58 away from the first side board 561.

The counter 60 is positioned on the support table 42 opposite to the cutting mechanism 40 for detecting and counting the number of the pieces for cutting. The rolling drum 80 including a pivot shaft 81 is rotatably connected with the pivot portions 263 via the pivot grooves 265. A mounting groove 85 is formed in a round surface of the rolling drum 80 for mounting the pipes 90.

In assembly, the fixing board 42 is firstly fixed to one end of the support table 42. Then the first, second, third rollers 447, 448, and 449 are mounted on the first fixing surface 421. The driver 462 is installed in the mounting hole 423. The driving wheel 464, and the driven wheel 468 are assembled with the first fixing surface 421. The pulley wheels 465 are sleeved on the rotating shafts 4622 and 4642. The strap 465 runs over the pulley wheels 465. The guiding member 47 is fixed to the first fixing surface 421 under the driven wheel 468. The cutter 48 is mounted on the first fixing surface 421 via the clamping groove 427. The sliding trough 428 is installed on first fixing surface 421. The cover 54 covers the second fixing surface 422. The first, second, third boards 561, 562, and 563 are assembled with the fixing board 42. The adjustment member 469 passes through the second side board 563, going into the fixing board 42, and resisting the rotating shaft 5642. The counter 60 is positioned at the support table 22 opposite to the cutting mechanism 40. The rolling drum 80 carrying pipe 90 is mounted on and rotatably connected with supporting rods 26.

The pipe 90 passes through the through hole 565 and the gap between the first roller 447 and the second roller 448. The pipe 90 runs over the third roller 449, passing through the gap between the driving wheel 464 and the driven wheel 468, and going into the clamping portion 471. The pipe 90 is clamped tightly between the driving wheel 464 and the driven wheel 468 via adjusting the adjustment member 469.

When in use, the driving wheel 464 rotates anticlockwise driven by the driver 462. The pipe 90 is driven to move towards the cutter 48. The pipe 90 reaches the position between the pushing block 484 and the blade edge 488; the pushing block 484 drives the pipe 90 towards the blade edge 488. The blade edge 488 cuts the pipe 90 into a piece of a certain length. Then the pushing block 484 and the blade 486 return to their initial positions. The cut piece drops into the sliding trough 428 and slides out. The counter 60 detects and counts the number of the pieces cut.

The driver 462 of the cutting mechanism 40 drives the driving wheel 462 to rotate anticlockwise. The pipe 90 clamped between the driving wheel 462 and the driven wheel 468 is driven to move towards the cutter 48. The pipe 90 is automatically cut into pieces of certain lengths by the cutting mechanism 40. The rolling drum 80 of cutting device 100 can rotate on the support rods 26, delivering the pipe 90 as the driving assembly 46 requires. The counter 60 counts the number of the pieces of the pipe 90.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A cutting mechanism for cutting a pipe, comprising:
a fixing board;
a cutter mounted on the fixing board, comprising:
a base body; and
a blade positioned on the base body; and
a driving assembly mounted on the fixing board for driving the pipe toward the blade to be cut into pieces of certain lengths;
wherein the driving assembly comprises a driver positioned at the fixing board, a driving wheel rotatably connected with the fixing board above of the cutter, and a driven wheel positioned at the fixing board above the cutter, the driving wheel being positioned between the driver and the driven wheel;
wherein the driving wheel and the driven wheel are configured to clamp the pipe there between; and the driving wheel is configured to be driven to rotate by the driver to drive the pipe move to the blade.

2. The cutting mechanism of claim 1, wherein the cutter further comprises a pushing block movably positioned on the base body relative to the blade; and
the pushing block pushes the pipes to the blade.

3. The cutting mechanism of claim 1, wherein the driven wheel is rotatably positioned at the fixing board above the cutter, and the driven wheel is driven to rotate by the driving wheel.

4. The cutting mechanism of claim 3, wherein the driving assembly further comprises a pair of pulley wheels and a strap, the pair of pulley wheels are positioned at a surface opposite to the driver, the pulley wheels sleeve respectively on the rotating shaft of the driver wheel and the driving wheel, and the strap runs over the pair of pulley wheels.

5. The cutting mechanism of claim 1, wherein the driving assembly further comprises an adjustment member, the adjustment member is positioned at one side surface of the fixing board adjoining the driven wheel and resists the driven wheel.

6. The cutting mechanism of claim 1 further comprising a roller group, wherein the roller group comprises at least one roller, the at least one roller is rotatably positioned on the fixing board above of the driving wheel, and the pipe runs over the at least one roller.

7. The cutting mechanism of claim 6, wherein the roller group comprises a first roller, a second roller and a third roller, all of the first roller, the second roller, and the third roller are rotatably positioned on the fixing board, the first roller is above of the driver, the second roller is above of the first roller, the third roller is above of the driving wheel and parallel to the first roller, the pipe passes through a gap between the first roller and the second roller and runs over the third roller.

8. The cutting mechanism of claim 1 further comprising a guiding member, wherein the guiding member is installed on the fixing board between the driving assembly and the cutter to guide the pipe to the cutter.

9. The cutting mechanism of claim 1, wherein a sliding trough is formed at the fixing board, the sliding trough is under the cutter, the pipe is cut into pieces with certain length, and the pieces drops into the sliding trough.

10. A cutting device, comprising:

a support;

a roller drum rotatably positioned on the support; and a cutting mechanism for cutting a pipe, comprising:

a fixing board;

a cutter mounted on the fixing board, comprising a base body and a blade positioned on the base body;

a driving assembly mounted on the fixing board for driving the pipe toward the blade to be cut into pieces of certain lengths; and a counter positioned on the support opposite to the cutting mechanism, wherein the roller drum is above the counter and the cutting mechanism, wherein the cutter further comprises a pushing block movably positioned on the base body relative to the blade, and the pushing block is configured for pushing the pipe to the blade.

11. The cutting device of claim 10, wherein the support comprises a support table and a pair of supporting rods, the fixing board is positioned at one end of the support table, the pair of support rods are parallelly configured adjacent to edges of one end opposite to the fixing board, and the roller drum is configured to pivot with the pair of supporting rods.

12. The cutting device of claim 10, wherein the driving assembly comprises a driver position at the fixing board, a driving wheel rotatably connected with the fixing board above the cutter, and a driven wheel positioned at the fixing board above the cutter; the driving wheel is between the driver and the driven wheel, the pipe is clamped between the driving wheel and the driven wheel; and the driving wheel is driven to rotate by the driver to drive the pipe to the blade.

13. The cutting device of claim 12, wherein the driven wheel is rotatably positioned at the fixing board, the driven wheel is driven to rotate by the driving wheel.

14. The cutting device of claim 13, wherein the driving assembly further comprises a pair of pulley wheels and a strap, the pair of pulley wheels are positioned at a surface opposite to the driver, the pulley wheels sleeve respectively on the rotating shaft of the driver and the driving wheel, and the strap runs over the pair of pulley wheels.

15. The cutting device of claim 13, wherein the driving assembly further comprises an adjustment member, the adjustment member is positioned at one side surface of the fixing board adjoining the driven wheel and resists the driven wheel.

16. The cutting device of claim 10, wherein a sliding trough is formed at the fixing board, the sliding trough is under the cutter, the pipe is cut into pieces with certain lengths, and the pieces drop into the sliding trough.

* * * * *